US005367964A

United States Patent [19]

Hockensmith

[11] Patent Number: 5,367,964

[45] Date of Patent: Nov. 29, 1994

[54] KNOCKDOWN PICNIC TABLE

[76] Inventor: William L. Hockensmith, HC 81 Box 76, Romney, W. Va. 26757

[21] Appl. No.: 155,300

[22] Filed: Nov. 22, 1993

[51] Int. Cl.[5] ..... A47B 3/00

[52] U.S. Cl. ..... 108/180; 297/157

[58] Field of Search ..... 108/180, 186, 153; 297/157, 159, 410.13; 211/189, 195

[56] References Cited

U.S. PATENT DOCUMENTS

| | | | |
|---|---|---|---|
| D. 171,751 | 3/1954 | Curtis . | |
| 2,235,290 | 3/1941 | Exline et al. . | |
| 2,522,774 | 9/1950 | Bower . | |
| 3,300,245 | 1/1967 | Rumble | 297/157 |
| 4,076,305 | 2/1978 | Sullivan | 297/157 |
| 4,223,945 | 9/1980 | Nikitits | 297/159 |
| 4,700,986 | 10/1987 | Davis et al. | 297/157 |
| 4,740,032 | 4/1988 | Olson et al. | 297/157 |
| 4,834,450 | 5/1989 | Stickler | 297/157 |
| 4,856,434 | 8/1989 | Smith | 108/180 X |
| 4,911,086 | 3/1990 | Belknap | 297/440.13 X |
| 5,251,955 | 10/1993 | Sarafa | 297/157 |

*Primary Examiner*—Jose V. Chen
*Attorney, Agent, or Firm*—William F. Hamrock

[57] ABSTRACT

The disclosure relates of to a picnic table which can be easily assembled and dismantled into eight prefabricated sections. The prefabricated sections are easily assembled by securing the sections in place within opposing notches, channels, securing blocks and pins. The sections can be easily dismantled and stacked together using storage blocks positioned within the structure in conjunction with securing blocks, channels, notches, pins and turnbutton positioned within the structure to secure the package into a compact unit.

8 Claims, 5 Drawing Sheets

KNOCKDOWN PICNIC TABLE

BACKGROUND OF THE INVENTION

1. Field of the Invention

The invention relates to a picnic table or similar structure and in particular to a durable prefabricated picnic table which can be easily assembled and dismantled, and can be securely packaged into a compact structure for easy transportation and storage.

2. Description of the Prior Art

There is a problem in the prior art in obtaining prefabricated picnic tables or similar structures which are durable, attractive, easy to assemble and to dismantle and easy to transport or to store.

Prior United States patents relate to various types of prefabricated picnic tables. However, many of these suffer from one or more of the following disadvantages of being difficult to assemble, or structure that are fragile with poor durability, or are difficult to dismantle, or structures that form bulky packages which are difficult to transport or to store.

U.S. Pat. No. 3,300,245 is an example of a prior art picnic table over which the present picnic table is an unexpected improvement. The present table's unique placement of cooperating securing and storage blocks, pins and bolts produce a firmly assembled table which can be stacked into a compact secure package.

SUMMARY OF THE INVENTION

The present invention solves many of the problems and shortcomings of the prior art by providing an attractive, durable picnic table which can be easily assembled and dismantled from only eight prefabricated sections. These prefabricated sections include a table top, two benchseats, two seat cross supports, two end supports, and a table top cross support. These prefabricated sections are easily assembled by simply sliding the connecting sections together and securing them in place within opposing notches, channels, securing blocks and pins.

When assembled, the separable notches and channels have been placed so that the connected sections are so secured as to make the table a solid unit. It can be picked up and moved about without it coming apart. The assembled unit does not give the appearance of being able to be taken apart which is one of many of its unique and unexpected features.

The picnic table can be easily dismantled. The dismantled table sections form a compact, secure package when the sections are stacked together. Storage blocks specifically positioned within the structure are used in conjunction with securing blocks, channels, notches, pins and turnbutton precisely positioned within the structure to secure the package in place.

It is an object of the present invention to provide a prefabricated picnic table which is attractive, durable and securely constructed.

It is another object of the present invention to provide a prefabricated picnic table which can be easily assembled and dismantled.

It is a further object of the present invention to provide a dismantled picnic table which can be securely and compactly stacked into prefabricated sections.

It is another further object of the present invention to provide strategically positioned elements within the structure to enhance secured packaging of the prefabricated sections.

It is another further object of the present invention to provide a picnic table made of prefabricated sections that are simply constructed.

It is another further object of the present invention to provide a securely and compactly stacked table which can be conveniently transported and stored.

The above objects are met with the present prefabricated picnic table.

DESCRIPTION OF THE PREFERRED EMBODIMENT

Figure 1:
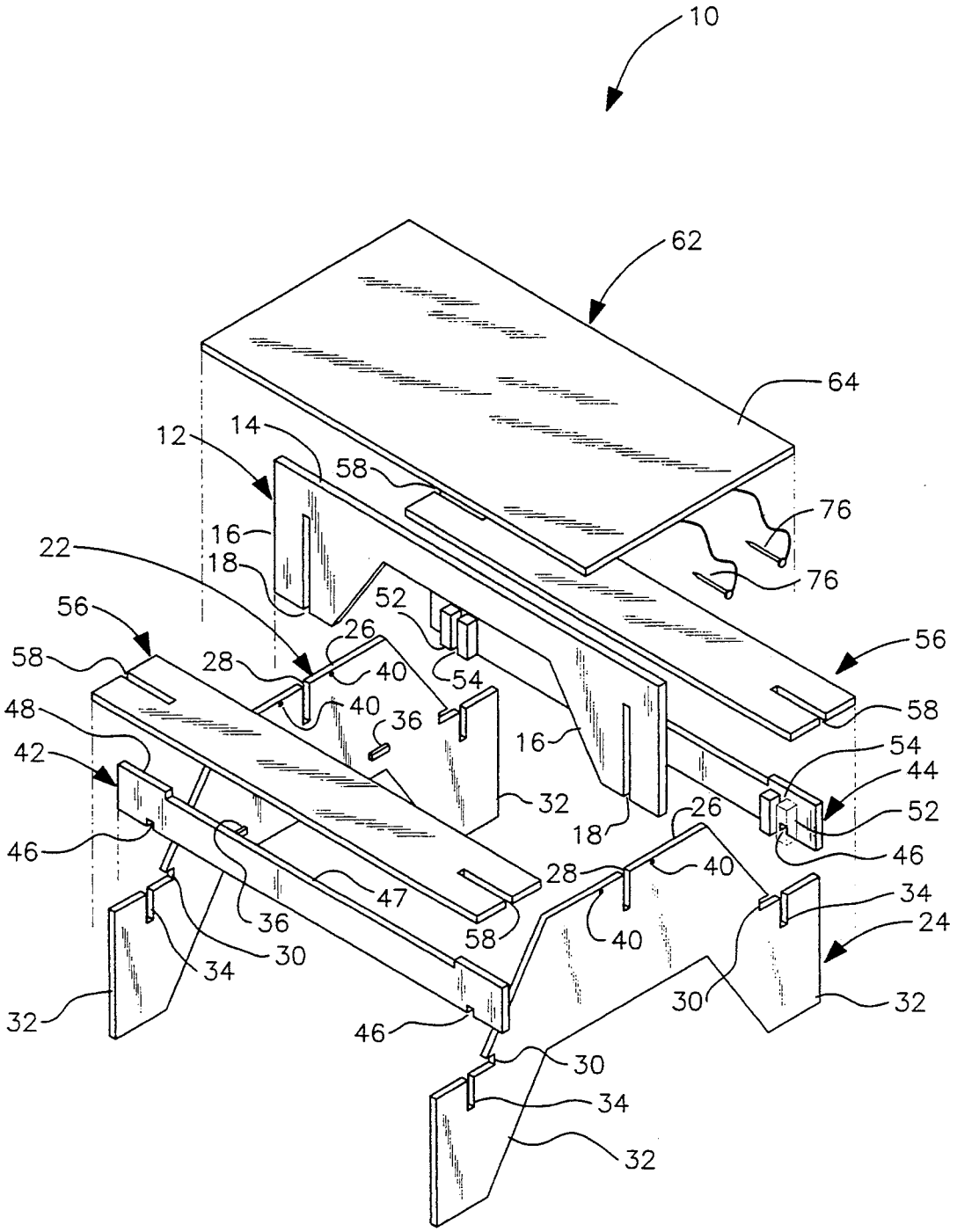
FIG. 1 is an perspective exploded view of all of the sections of the picnic table.

Referring more specifically to the drawings, the prefabricated picnic table 10 is shown in FIG. 1. It is composed of eight prefabricated sections: a table top section 62, a main cross support 12, a pair of end support sections 22 and 24, a pair of seat cross support sections 42 and 44, and a pair of bench seat sections 56. The sections are preferably prepared from a sturdy plywood with durable securing and storage blocks and metal pins to hold the sections together. The dimensions may be varied to conform to the table requirements depending upon needs of the user. Other materials such as a sturdy plastic may also be used.

The table may be assembled in any desired order of attaching the aligned sections. The following procedure is usually followed in assembling the table. The main cross support section 12 is connected to the left and right end support sections 22 and 24 by aligning and securing ascending notches 18 within descending notches 28. Next, front and rear seat-cross-support sections 42 and 44 are attached to the seat-end-support 32 by aligning and securing seat-cross-support notches 46 within seat-end-support notches 34. Mounting and securing blocks 52 and channels 54 add additional support in connecting rear seat-cross-support 44 to the seat-end-support 32. The bench-seat sections 56 are then secured to the seat-end-supports 32 by aligning and securing bench-seat horizontal notches 58 within raised shoulders 48 onto seat-cross-support 47 and sliding into end support notches 30. The table top section 62 is attached to the structure by aligning the securing and storage blocks 68 and vertical or end extending 72 and horizontal or front to rear extending 74 channels shown on FIG. 3 to fit onto main cross support 12 and end support sections 22 and 24. The table top section 62 is then releasably secured to the structure by inserting metal pins 76 into aligned predrill pin holes 70 of the securing storage blocks as seen in FIG. 4 and aligned predrilled pin holes 40 of the end support sections.

Figure 2:
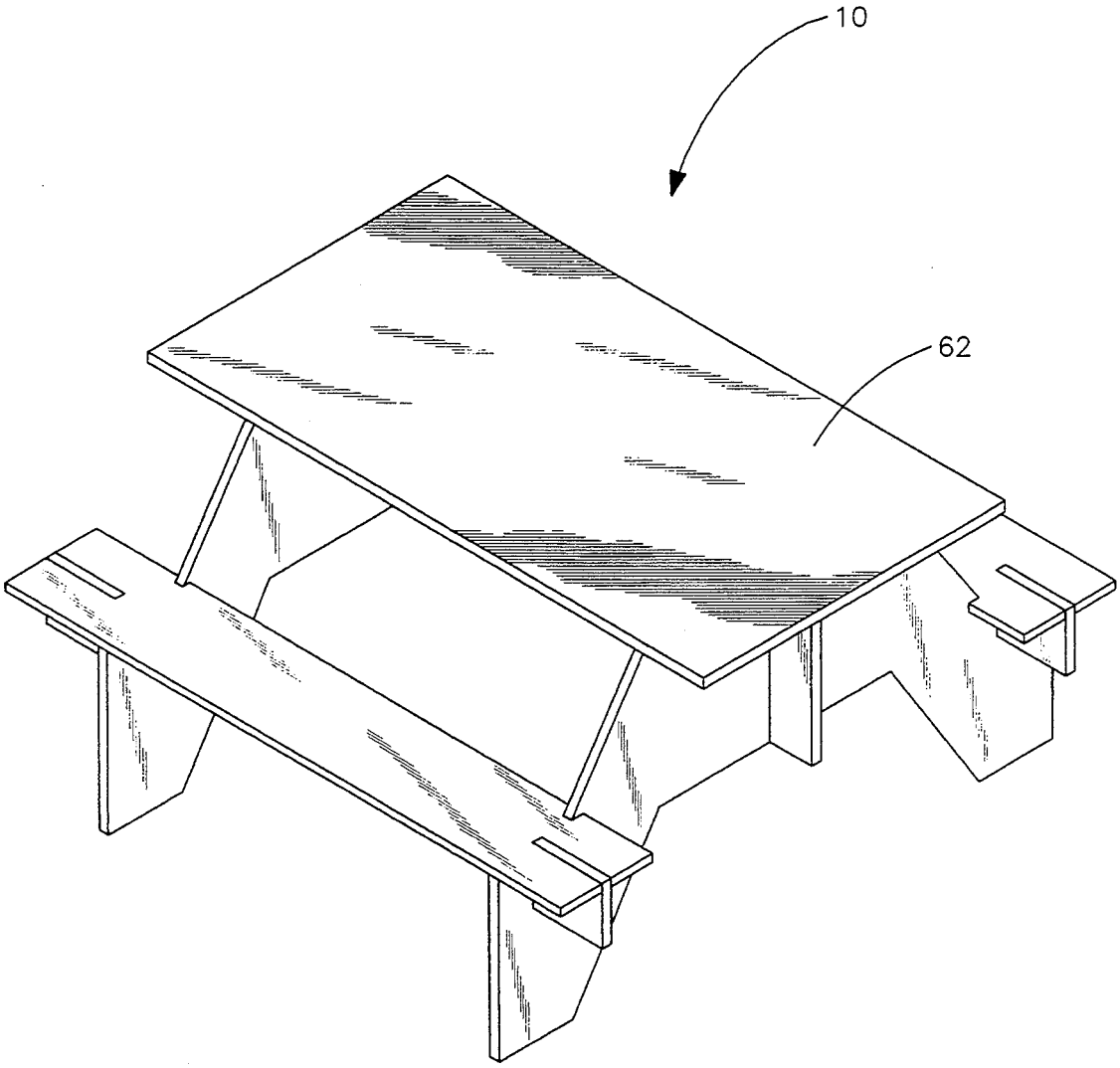
FIG. 2 is a perspective view of the assembled picnic table.

The picnic table is now securely assembled as shown in FIG. 2. The assembled table can be picked up by its top section and carried about without its elements becoming disengaged and falling apart. Metal pins 76 lock the table top to the structure by passing through the aligned predrilled block holes 70 in securing blocks 68 with predrilled holes 40 in end support section 22 and 24.

The most important feature of the picnic table is that it can be easily dismantled and stacked into a compact secure package for easy transport and storage. This is accomplished by the critical placement of storage and securing blocks and coupling elements within the structure so that they cooperate with the various features of the picnic table sections to produce a secured compact unit.

Figure 3:
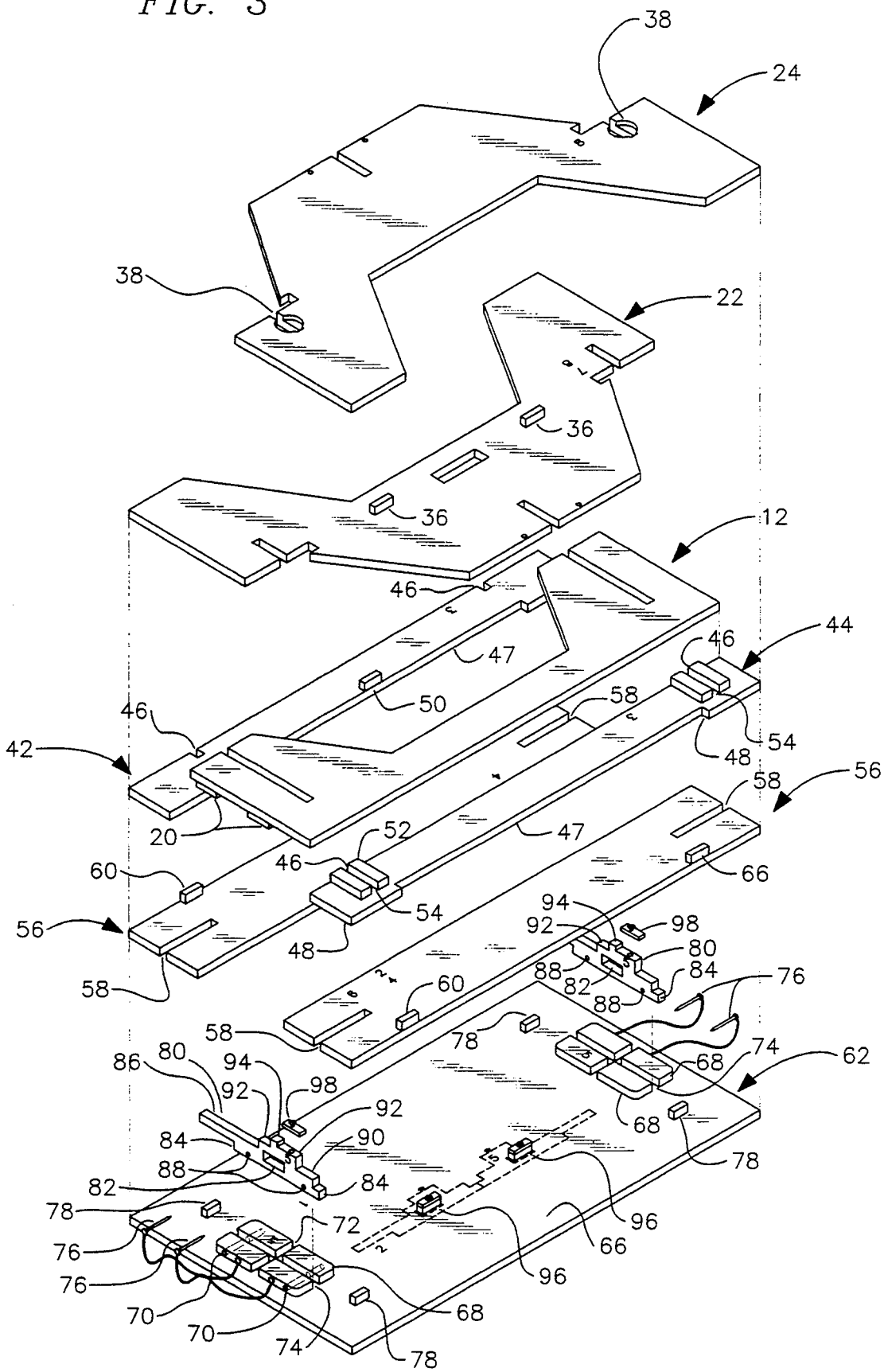
FIG. 3 is a perspective exploded view of all the disassembled sections in order to be securely packaged.
Figure 4:
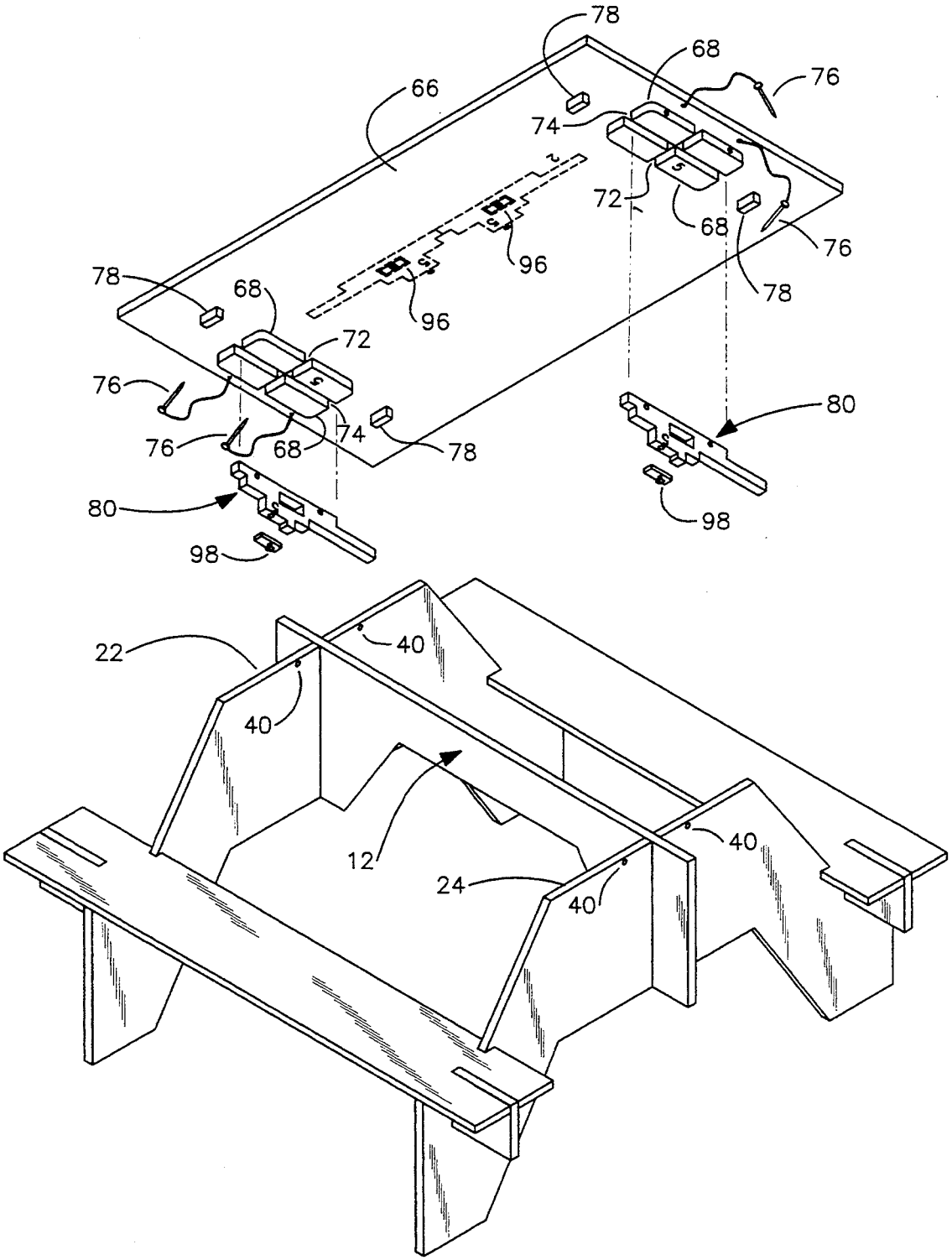
FIG. 4 is a perspective view of the partially dismantled table.
Figure 5:
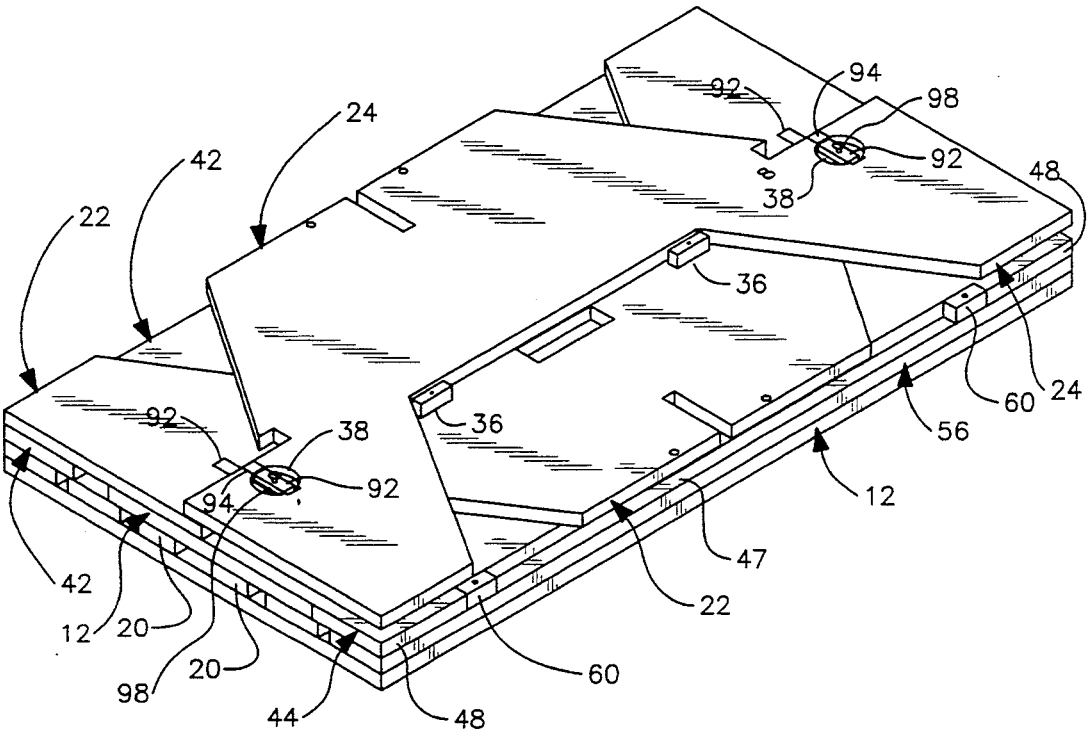
FIG. 5 is a perspective view of the securely package picnic table.

The picnic table is dismantled and stacked as shown in FIGS. 3, 4 and 5 in the following manner.

1) The table top section 62 is placed with its lower surface 66 facing upwardly exposing table top storage blocks 78 and longitudinal storage blocks 80. Initially, the longitudinal blocks 80 which are stored and are releasably attached on securing blocks 96 by turnbutton 98 are removed therefrom as seen in FIG. 4. The individual sections are then stacked as indicated in FIG. 3.

2) The bench seat sections 56 are placed with the inner surface facing upwardly and exposing storage blocks 60. Bench seat sections 56 are attached to the table top lower surface 66 by aligning and securing the bench seat horizontal notches 58 within table top storage blocks 78.

3) The front and rear seat cross support sections 42 and 44 are placed with bottom surfaces facing upwardly exposing the seat-cross-support notches 46 and front seat cross support storage block 50 and rear seat-cross-support mounting and storage blocks 52 and channels 54, Sections 42 and 44 are attached by aligning and securing raised shoulders 48 wedged against bench seat securing blocks 60.

4) It is at this time that a critical procedural step occurs which enhances this unique compact packaging and storage of the dismantled table. Initially in step 1), longitudinal storage blocks 80 have been released from the bolted positions from securing blocks 96 on the table lower surface 66 as seen in FIG. 4. Bottom portion 82 of storage block 80 is aligned and secured within horizontal or front to rear extending channel 74 and thereby securely wedging slightly overlapped its bottom end portions 84 against the opposing bench seat sections 56. Extension arm 86 of storage block 80 which extends compressively across front bench seat section 56 and is aligned and secured within seat-cross-support notch 46 of the front seat-cross-support section 42. The structure is further secured by metal pins 76 passing through aligned predrilled block holes 70 in storage and securing blocks 68 and into the aligned predrilled holes 88 in longitudinal storage blocks 80 so that the only element that is not compactly secured in the package at this time is the rear seat-cross-support section 42.

5) Next, main-cross-support section 12 is placed with its front surface facing upwardly and its arms facing frontwardly thereby aligning and securing cross-support notches 18 within the second level 90 of longitudinal storage blocks 80, aligning and securing the underlying storage blocks 20 on the outer edge of table top securing and storage blocks 68, and securely wedging top cross support 14 against the rear-seat-cross-support section 44 to firmly secure the entire package.

6) Attaching end support sections 22 and 24 complete the packaging of the picnic table. Left end support section 22 is placed with its top end support facing rearwardly and its inner side facing upwardly exposing storage blocks 36. Left end support section 22 is attached to the longitudinal storage blocks 80 by aligning and securing longitudinal storage blocks 80 at its third level 92 within seat-end-support notches 34.

7) In the final step, right end support section 24 is placed with its top level support facing frontwardly and its inner side facing upwardly exposing turnbutton storage slots 38. End support section 24 is attached by aligning and securing longitudinal storage blocks 80 at its top level 94 within the seat support notches 34 thereby wedging right end support section 24 against storage blocks 36 of left end support section 22 and resting on the rear-seat-cross support mounting and storage blocks 52.

8) The entire structure is then firmly secured together by securing screw and turnbutton 98 within bolt storage slots 38 as shown in FIG. 5.

The entire structure is now securely packaged. The securely packaged table can now be transported or put in storage as a compact unit. The strategically placed storage blocks have been used in conjunction with the strategically placed securing blocks, channels, notches, metal pins and bolts to firmly secure the compact package for movement and storage.

It will be apparent to those skilled in the art from the foregoing description and accompanying drawings that additional modifications and/or changes of the disclosed embodiments may be made without departure from the invention.

PICNIC TABLE PARTS LIST

10 Picnic Table
12 Main cross support section
14 Top cross-support
16 Cross-support arm
18 Cross-support notch
20 Cross-support storage blocks
22 Left-end support section
24 Right end-support section
26 Top end-support
28 Descending central notch
30 End-support horizontal notch
32 Seat-end-support
34 Seat-end-support notch
36 Left end-support storage block
38 Turnbutton storage slot
40 End support hole
42 Front seat-cross-support section
44 Rear seat-cross-support section
46 Bench seat cross support notch
47 Seat-cross-support
48 Raised shoulder
50 Front seat-cross-support storage block
52 Mounting and storage blocks
54 Mounting channel
56 Bench-seat section
58 Bench-seat horizontal notch
60 Bench-seat storage block
62 Table top section
64 Table top upper surface
66 Table top lower surface
68 Securing and storage block
70 Block hole
72 Vertical or end extending channel
74 Horizontal or front to rear extending channel
76 Metal pins
78 Table top storage block
80 Longitudinal storage block
82 Bottom portion 84 Overlapping portion
90 Second Level
86 Extension arm
88 Predrilled pin holes
92 Third level
94 Top level
96 Securing blocks
98 Screw and turnbutton

What is claimed is:

1. A prefabricated picnic table which can be securely assembled, and dismantled into compactly secured sections comprising:

eight prefabricated sections comprising, a table top section comprising an upper and lower surface, two side edges, and a front and a rear edge the lower surface having securing blocks forming first and second sets of intersecting end and front to rear extending channels each set including an end and a front to rear extending channel with securing means releasably attached thereto, and the lower surface having longitudinal storage blocks releasably mounted thereon, a cross support section having an elongated upper table top support and opposing descending securing arms, the upper table top support adapted to be aligned and secured within said end extending channels of the table top section, left and right table end support sections, each having opposing seat supports, each table end support section having an elongated upper surface adapted to be aligned and secured within said front to rear extending channels of the table top section and with said descending securing arms of the cross support section, the left table end support having spaced apart storage blocks, front and rear seat cross support sections adapted to be aligned and secured within said seat supports, each bench seat cross support section having opposing raised shoulders, the rear seat cross support section having two spaced apart pairs of mounting and securing blocks adapted for aligned mounting engagement with said seat supports, a pair of bench seat sections adapted to be aligned and secured with said seat cross support sections and said seat supports, each bench seat section having spaced apart storage blocks, whereby said picnic table sections are dismantled and stacked into compactly secured sections by first releasing said longitudinal storage blocks and then aligning and releasably mounting the longitudinal blocks within the stacked sections and securely coupling the stacked sections together with the longitudinal blocks.

2. An assembled picnic table according to claim 1 wherein said securing means releasably attached to said securing blocks are metal pins.

3. An assembled picnic table according to claim 2 wherein said metal pins secure said elongated upper table top support within said end extending channels.

4. An assembled picnic table according to claim 1 wherein each of said longitudinal blocks is releasably attached to a securing block.

5. An assembled picnic table according to claim 4 wherein each longitudinal block is releasably attached with a securing screw and turnbutton.

6. A dismantled and stacked picnic table according to claim 1 wherein each of said longitudinal blocks is aligned and secured within said front to rear extending channels.

7. A dismantled and stacked picnic table according to claim 6 wherein said longitudinal blocks are secured by said metal pins through said securing blocks.

8. A dismantled and stacked picnic table according to claim 7 wherein the stacked table sections are secured together by a securing screw and turnbutton.

* * * * *